US006732949B1

(12) United States Patent
Harn Dorf

(10) Patent No.: US 6,732,949 B1
(45) Date of Patent: May 11, 2004

(54) FUEL INJECTION VALVE FOR INTERNAL COMBUSTION ENGINES

(75) Inventor: Horst Harn Dorf, Schwieberdingen (DE)

(73) Assignee: Robert Bosch GmbH, Stuttgart (DE)

( * ) Notice: Subject to any disclaimer, the term of this patent is extended or adjusted under 35 U.S.C. 154(b) by 263 days.

(21) Appl. No.: 09/889,972

(22) PCT Filed: Nov. 24, 2000

(86) PCT No.: PCT/DE00/04181

§ 371 (c)(1),
(2), (4) Date: Oct. 22, 2001

(87) PCT Pub. No.: WO01/38724

PCT Pub. Date: May 31, 2001

(30) Foreign Application Priority Data

Nov. 25, 1999 (DE) ..... 199 56 510

(51) Int. Cl.[7] ..... B05B 1/08

(52) U.S. Cl. ..... 239/102.2; 239/88; 239/533.2; 239/533.4; 251/129.06; 310/327

(58) Field of Search ..... 239/102.2, 102.1, 239/88–96, 584, 533.2–533.12; 251/129.06; 123/498; 310/326, 327

(56) References Cited

U.S. PATENT DOCUMENTS 5,697,554 A * 12/1997 Auwaerter et al. ..... 239/88
6,585,171 B1 * 7/2003 Boecking ..... 239/102.1

FOREIGN PATENT DOCUMENTS

DE 4332124 A * 3/1995
DE 19623211 A * 12/1997

* cited by examiner

*Primary Examiner*—Dinh Q. Nguyen
(74) *Attorney, Agent, or Firm*—Ronald E. Greigg

(57) ABSTRACT

A fuel injection valve has a valve body and a valve member axially movable within the valve body. The opening stroke of the valve member is limited by a stroke stop face provided on a control piston which surrounds the valve member. A control chamber, which may be filled with fuel, is located at one end of the control piston. At a certain pressure in the control chamber, the control piston moves from a first to a second stroke position to limit the opening stroke motion of the valve member. Part of the control piston is embodied as a piezoelectric actuator which, when supplied with electric current, changes its axial length to further vary the stroke of the valve member.

25 Claims, 5 Drawing Sheets

FUEL INJECTION VALVE FOR INTERNAL COMBUSTION ENGINES

PRIOR ART

Figure 1:
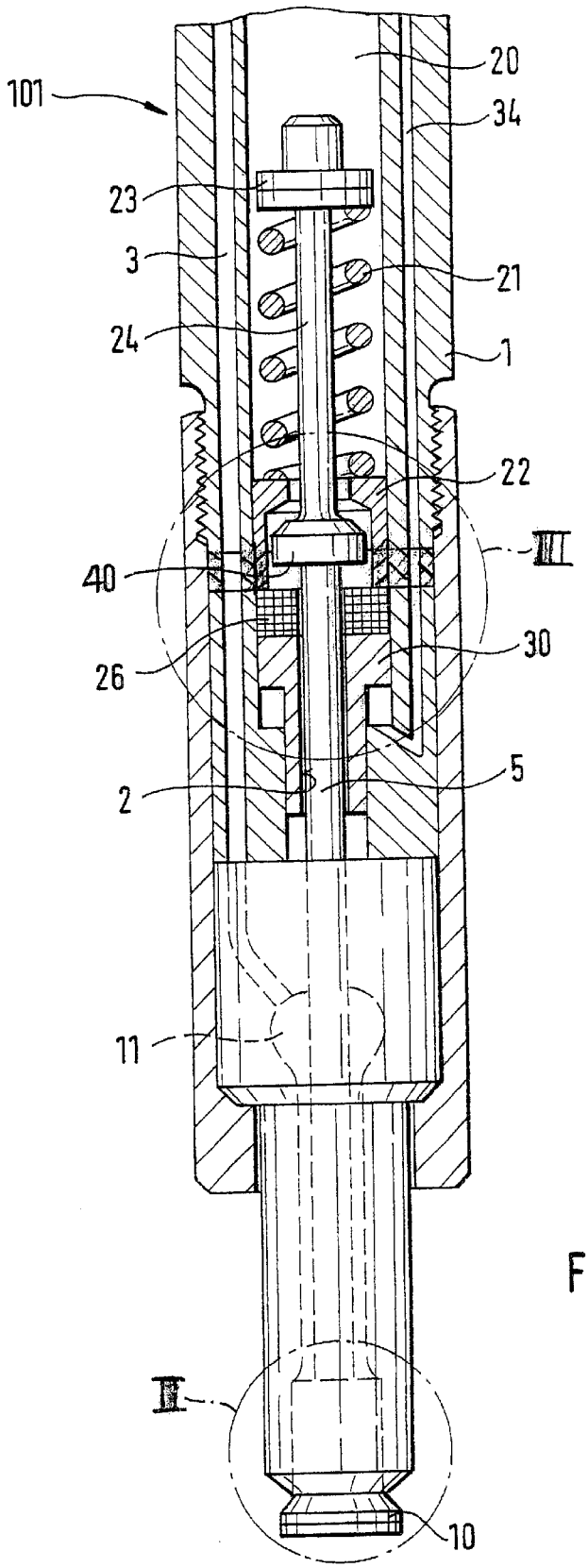

The invention is based on a fuel injection valve for internal combustion engines as generically defined by the preamble to claim 1. One such fuel injection valve, known from German Patent Disclosure DE 196 23 211 A1, has a valve body in which, in a bore, a piston like valve member is disposed such that it is movable axially counter to the force of a closing spring. On the end toward the combustion chamber, the valve member changes over into a closing head, which is guided in the bore. In the outward-oriented opening stroke motion of the valve member, the closing head emerges from the bore, and a control edge embodied on the closing head uncovers at least one injection opening. A plurality of injection openings can also be provided, which are opened successively by the control edge. As a result, by a limitation of the opening stroke of the valve member to a partial stroke, it becomes possible to uncover only some of the injection openings or to open only a partial cross section of one injection opening, and thus to control the entire effective injection cross section as a function of the opening stroke of the valve member. The opening stroke motion is limited to a partial stroke by a control piston, disposed in the valve body, whose end face defines a hydraulic control chamber. The control chamber can be filled with fuel at high pressure and as a result can displace the control piston axially from a first stroke position to a second stroke position, as a result of which the valve member executes either the maximum stroke or only a partial stroke. A hydraulically adjustable stroke stop of this type has a black-and-white function; that is, it does not allow any graduations between the two opening strokes. This limits the control capability of the fuel injection event, making further optimization of the injection event more difficult.

In a fuel injection valve of the inward-opening type as well, such as that known from German Patent Disclosure DE 197 29 843, it can be desirable for the sake of precise metering of a preinjection quantity to have a partial stroke available that has more than a black-and-white function, allowing an optimal injection course to be attained.

ADVANTAGES OF THE INVENTION

The fuel injection valve of the invention for internal combustion engines, having the characteristics of the body of claim 1, has the advantage over the prior art that between the closing spring and the guided portion of the valve member, a combined hydraulically and piezoelectrically controlled stroke stop is embodied, with which the opening stroke motion of the valve member can be set to any value between the maximum opening stroke and the partial stroke. By combining the hydraulically adjustable piston with a piezoelectric actuator, it is possible to switch the hydraulic piston not only between maximum stroke and partial stroke but also, by the delivery of electric current to the piezoelectric actuator, to switch it between the partial stroke and any arbitrary value between partial stroke and the maximum opening stroke of the valve member. As a result, in a further performance graph range of the engine, an optimally adapted opening stroke of the valve member is feasible. If switching between only partial stroke and a maximum opening stroke is necessary, then the piezoelectric actuator need not be supplied with electric current, which is advantageous from an energy standpoint.

Besides the use of the combined hydraulic and piezoelectrically controlled stroke stop in an outward-opening vario-nozzle, it is also possible to use the subject of the invention in an inward-opening fuel injection valve in the same advantageous way.

In an advantageous feature of the stroke stop, the control piston is embodied as a hollow cylinder, on the end of which remote from the combustion chamber the piezoelectric actuator is disposed.

This makes it easy to mount the control piston, since the piezoelectric actuator and the non-piezoelectrically active part of the control piston can be installed separately. In a control piston embodied in this way, in a further advantageous feature, the valve member in the opening stroke motion does not come into direct contact with the piezoelectric actuator but only with the interposition of a shim. This results in less wear on the piezoelectric actuator and thus a longer service life of the hydraulic stroke stop. Furthermore, the shim offers the capability, by replacement of this simple and hence economically produced shim, of setting the maximum opening stroke precisely by way of the thickness of the shim.

In a further advantageous feature, the control pressure for controlling the hydraulic stroke stop is drawn from a control line, which communicates with a high-pressure reservoir via a control valve. Furthermore, via a further control valve, the control line communicates with the largely pressureless fuel tank, so that by suitably triggering the two valves, loading and relieving of the control line are possible, without requiring a further high-pressure fuel source.

Further advantages and advantageous features of the subject of the invention can be learned from the description, drawing and claims.

DRAWING

Figure 2:
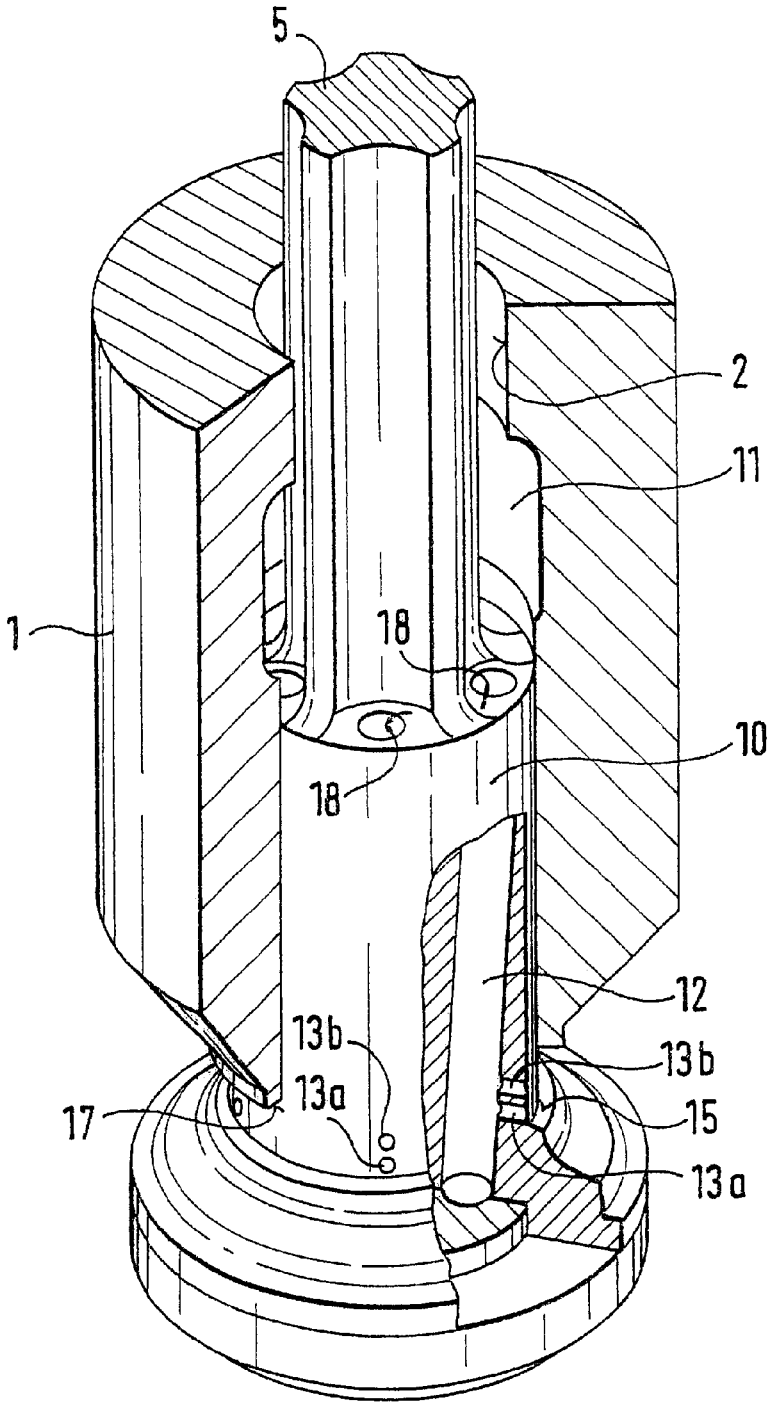
Figure 3:
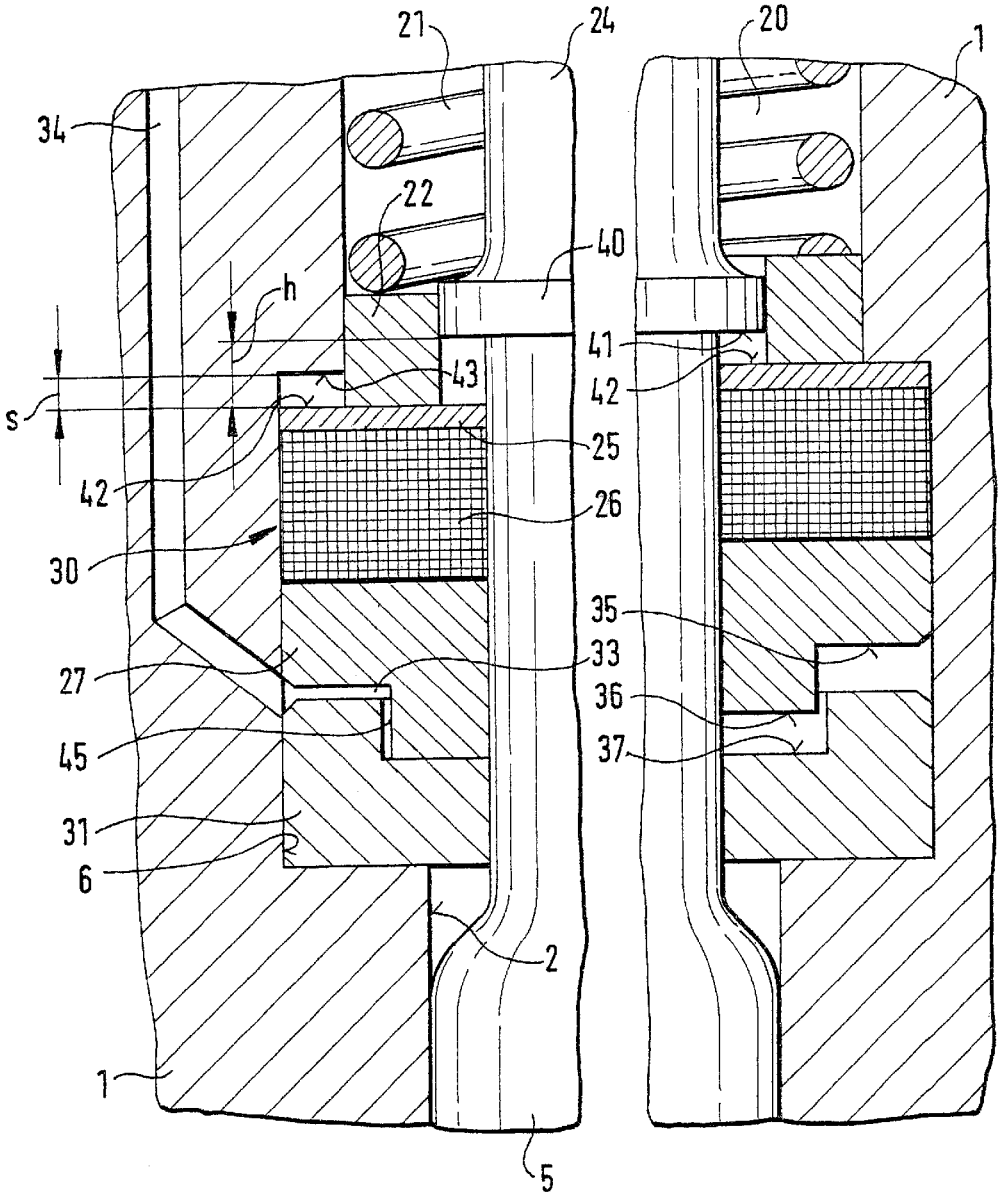
Figure 4:
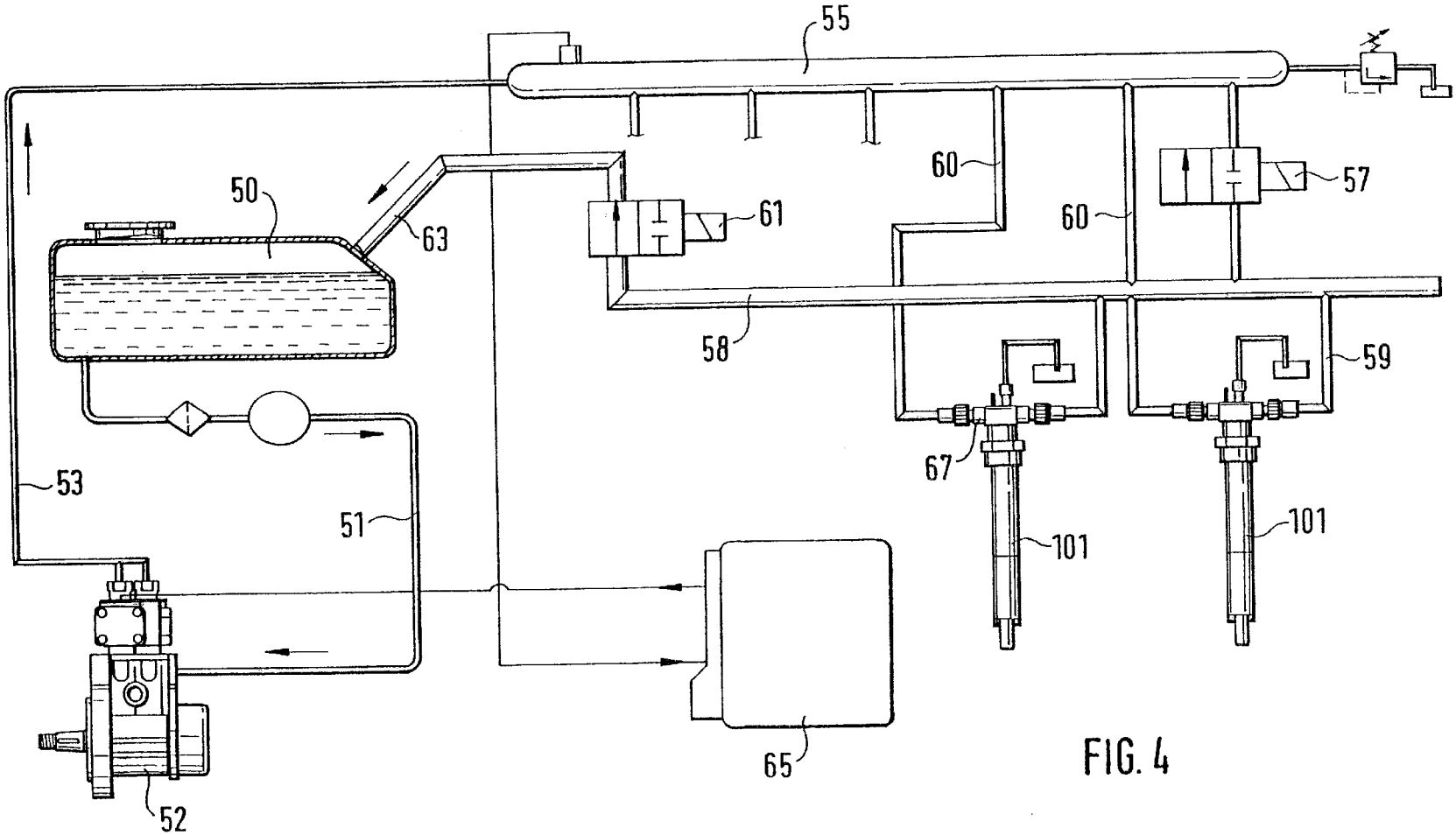
Figure 5:
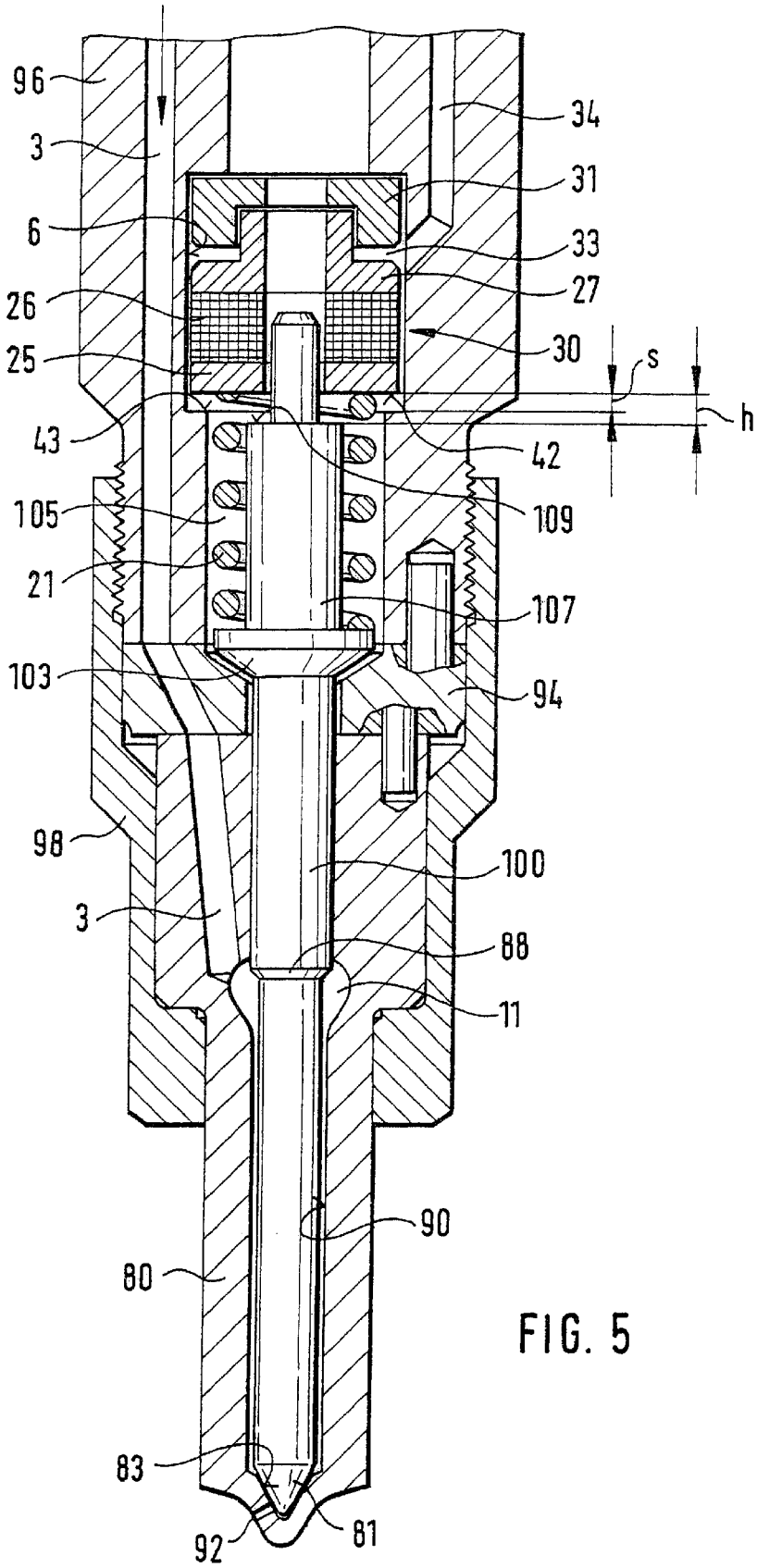

One exemplary embodiment of the fuel injection valve according to the invention for internal combustion engines is shown in the drawing and will be described in further detail in the ensuing description. Shown are FIG. 1, a longitudinal section through the fuel injection valve;

FIG. 2, an enlarged view of the detail marked II in FIG. 1, in the region of the closing head;

FIG. 3, an enlarged view of the detail marked III in FIG. 1, in the region of the stroke stop;

FIG. 4, the schematic layout of the fuel supply system for fuel injection and for furnishing fuel control pressure for the hydraulically adjustable stroke stop; and FIG. 5, a fuel injection valve of the invention, of the inward-opening type, in longitudinal section.

DESCRIPTION OF THE EXEMPLARY EMBODIMENT

FIG. 1 shows a fuel injection valve for internal combustion engines of the outward-opening type. In a valve body 1, which can be constructed in multiple parts, a bore 2 is made in which a piston like valve member 5 is disposed, which is axially movable counter to the force of a closing spring 21. In a portion, shown at the top in FIG. 1, of the bore 2 that is remote from the combustion chamber, the valve member 5 is guided, while the portion of the valve member 5 remote from the combustion chamber and shown at the bottom in FIG. 1 is surrounded by a pressure chamber 11, which can be made to communicate with a high-pressure fuel source via an inlet conduit 3 embodied in the valve body 1. The valve member 5 merges toward the combustion chamber with a larger-diameter closing head 10, which is guided in a larger-diameter portion of the bore 2.

In FIG. 2, an enlarged view of the closing head 10 and the surrounding valve body 1 is shown. On the outer wall of the closing head 10, two rows of injection openings 13*a* and 13*b* are provided, with one row including all the injection ports that are disposed at the same height as the closing head. The injection openings 13*a* and 13*b* communicate with the pressure chamber 11 via injection conduits 12, which are embodied in the closing head 10. In the closed state of the fuel injection valve, a valve sealing face 15 embodied on the closing head 10 comes to rest on the face end of the valve body 1, which end is embodied as a valve seat face 17, and the injection openings 13*a*, 13*b* are covered by the valve body 1. Because the diameter of the closing head 10 is larger in comparison to the valve member 5, a pressure shoulder 18 is embodied on the end of the closing head 10 remote from the combustion chamber, and this shoulder is exposed to the fuel pressure in the pressure chamber 11. As an alternative to the embodiment shown in FIG. 2, it can also be provided that more than two rows of axially offset injection openings 13*a*, 13*b* are disposed on the outer jacket face of the closing head 10. In a further embodiment, it can also be provided that only one rows of injection openings 13*a*, 13*b* is provided on the outer jacket face of the closing head 10, and the cross section of this row is opened either entirely or only in part in the opening stroke motion of the valve member 5.

On its end remote from the combustion chamber, the valve member 5 changes over into a spring tappet 24, which protrudes as far as the inside of a spring chamber 20 embodied in the region of the valve body 1 remote from the combustion chamber. On the end of the spring tappet 24 remote from the combustion chamber, a spring plate 23 is embodied, on which the closing spring 21 is braced by its end remote from the combustion chamber. The spring chamber 20 communicates, via an outlet conduit embodied in the valve body 1 but not shown in the drawing, with an outlet line in order to carry away the leaking oil entering the spring chamber 20.

FIG. 3 shows an enlarged view of the adjustable stroke stop of FIG. 1. Between the guided portion of the valve member 5 and the spring chamber 20, a larger-diameter guide bore 6 is formed. Disposed in the guide bore 6 are a control stop 31, connected to the valve body 1, and a control piston 30, which is movable axially in the guide bore 6. The control stop 31 is disposed on the end of the guide bore 6 remote from the spring chamber 20 and is embodied as a hollow cylinder, whose inside diameter is graduated, with the portion having the larger inside diameter being toward the spring chamber 20. The control piston 30 is likewise embodied as a hollow cylinder, and its outer diameter is graduated, and the portion having the smaller diameter is located remote from the spring chamber 20. The portion of the control piston 30 having the smaller outer diameter plunges into the portion of the control stop 31 of larger inside diameter, and between the control piston 30 and the control stop 31, a throttle gap 45 is formed. The outer annular end face 35, formed on the control piston 30 toward the combustion chamber by the graduated outer diameter, on the one hand and the control stop 31 on the other define a control chamber 33, to which a control conduit 34 extends that is embodied in the valve body 1. Via the throttle gap 45, only little fuel can flow from the control chamber 33 past the valve member 5 into the spring chamber 20. The control piston 30 is constructed in two parts; the hollow-cylindrical portion toward the spring chamber 20 is embodied as a piezoelectric actuator 26, and the other part forms a graduated hydraulic piston 27. For delivering electric current to the piezoelectric actuator 26, suitable electrical contacts are disposed on it, which are connected to a suitable voltage source via an electric line, not shown in the drawing. The electric line can for instance be guided in a separate conduit embodied in the valve body 1, or it can be extended to the outside through the spring chamber and the outlet conduit, not shown in the drawing, of the spring chamber 20.

Toward the spring chamber 20, a support disk 25 is disposed on the piezoelectric actuator 26, and its face end toward the spring chamber 20 is embodied as a stroke stop face 42, which in the stroke motion of the control piston 30, oriented toward the spring chamber 20, comes to rest on a control piston stop 43 formed by the cross-sectional reduction from the guide bore 6 to the spring chamber 20. A spring support ring 22 is disposed in the spring chamber 20, and the closing spring 21 is braced on this ring by its end toward the combustion chamber. The spring support ring 22 is guided in the spring chamber 20 and is pressed against the support disk 25 by the force of the closing spring 21. At the transition from the valve member 5 to the spring tappet 24, a annular collar 40 extending all the way around is embodied on the valve member 5; its annular end face toward the combustion chamber is embodied as a stop face 41. In the opening stroke motion of the valve member 5 oriented toward the combustion chamber, this stop face 41 comes to rest on the stroke stop face 42 embodied on the shim 25, thereby defining the opening stroke.

In FIG. 4, the layout of the high-pressure fuel supply is shown schematically. From a fuel tank 50, fuel is delivered via a low-pressure line 51 to a high-pressure fuel pump 52. The high-pressure fuel pump 52 pumps fuel at high pressure through a high-pressure line 5 into a high-pressure reservoir 55. For each fuel injection valve 101 of the internal combustion engine, one fuel inlet line 60 leads away from the high-pressure reservoir 55 and communicates at the fuel injection valve 101 with the inlet conduit 3. Between the inlet conduit 3 and the fuel inlet line 60, there is a metering valve 67, with which the communication from the high-pressure reservoir 55 to the inlet conduit 3 can be opened or closed. The high-pressure reservoir 55 can be made to communicate with a control line 58 via a control valve 57. Since a certain high fuel pressure is always maintained in the high-pressure reservoir 55, by opening the control valve 57 fuel can be carried at high pressure into the control line 58, as a result of which the pressure in the control line 58 adapts to that in the high-pressure reservoir 55. Each fuel injection valve 101 communicates with the control line 58 via a control inlet line 59 that communicates with the control conduit 34 in the valve body 1. The control line 58 can be made to communicate with the fuel tank 50, acting as a relief chamber, via an outlet line 63 in which a control valve 61 is disposed. By opening the control valve 61, the pressure in the control line 58 can be relieved at any time to the pressure level of the fuel tank 50, which is approximately equivalent to atmospheric pressure. The entire fuel injection system is controlled by a control unit 65, which includes a computer, which by means of the measured values of various sensors, not shown in the drawing, controls the high-pressure fuel pump 52, the control valves 61 and 57, the metering valves 67, and the supply of electric current to the piezoelectric actuator 26.

The mode of operation of the fuel injection valve shown in FIG. 1 is as follows:

At the onset of the injection event, the metering valve 67 opens the communication from the fuel inlet line 60 to the inlet conduit 3. As a result, fuel flows out of the high-pressure reservoir 55 through the fuel inlet line 60 and the inlet conduit 3 into the pressure chamber 11. The fuel pressure in the pressure chamber 11 rises, until the resultant force in the axial direction on the pressure shoulder 18 is greater than the force of the closing spring 21. The valve member 5 moves outward toward the combustion chamber, and as a result the two injection openings 13*a* and 13*b* emerge in succession from the bore 2, as a result of which the pressure chamber 11 communicates with the combustion chamber, and fuel is injected into the combustion chamber. By means of the outward-oriented opening stroke motion of the valve member 5, the annular collar 40 also moves toward the combustion chamber, and thus the stop face 41 moves toward the stroke stop face 42. Whether the valve member 5 executes the maximum stroke h or only a partial stroke depends on the status of the control piston 30.

The mode of operation of the adjustable stroke stop is as follows:

In the closed state of the fuel injection valve, that is, when the valve sealing face 15 is in contact with the valve seat face 17 and when the control chamber 33 of the hydraulic stroke stop is pressureless and there is no current to the piezoelectric actuator 26, the stroke stop face 42 has an axial spacing from the stop face 41 of the annular collar 40 that is equivalent to the maximum opening stroke h of the valve member 5. This status is shown in the left half of FIG. 3. If the control chamber 33 is without fuel pressure, then the inner annular end face 36 of the control piston 30 is in contact with the seat face 37 of the control stop 31. If then, with the control valve 57 open and the control valve 61 closed, fuel is introduced into the control chamber 33 via the control conduit 34, the pressure in the control chamber 33 then rises until the resultant force on the outer annular end face 35 is greater than the force of the closing spring 21. The control piston 30 moves toward the spring chamber 20, until after the execution of the control stroke s, it comes to rest with the stroke stop face 42 on the control piston stop 43. This status is shown in the right half of FIG. 3. The control stroke s is shorter than the maximum opening stroke h. In the opening stroke motion of the valve member 5, the stop face 41, after the execution of the stroke h-s, comes to rest on the stroke stop face 42. The control stroke s amounts to approximately 30 to 70% of the maximum opening stroke h, so that by subjecting the control chamber 33 to pressure with the resultant stroke motion of the control piston 30, the opening stroke motion of the valve member 5 is limited to from 70 to 30% of the maximum opening stroke h. If the valve member 5 is meant to execute the maximum opening h again, then the pressure in the control chamber 33 is reduced by relief of the control line 58 into the fuel tank 50, with the control valve 57 closed, via the control valve 61 and the outlet line 63. If the force of the closing spring 21 exceeds the force of the fuel pressure on the inner annular end face 36 of the control chamber 33, then the control piston 30 is pressed toward the combustion chamber by the closing spring 21, until the inner annular end face 36 rests on the seat face 37. If the stroke stop face 42 is meant to execute only a portion of the control stroke s, then current is supplied to the piezoelectric actuator 26. Because of the change in length of the piezoelectric actuator 26 in response to the voltage applied, the stroke stop face 42 can be raised continuously variably to any arbitrary portion of the control stroke s. The maximum possible change in length of the piezoelectric actuator 26 is then equivalent approximately to the control stroke s, for instance.

In FIG. 5, a fuel injection valve of the invention of the inward-opening type is shown in longitudinal section. A bore 90 embodied as a blind bore is disposed in a valve body 80, and its bottom face is oriented toward the combustion chamber. A conical valve seat 83 is embodied on the bottom face along with at least one injection opening 92, which connects the bore 90 with the combustion chamber. By means of a lock nut 98 and with the interposition of a shim 94, the valve body 80 is braced against a valve holding body 96, which can be constructed in multiple parts.

A pistonlike valve member 100 that is longitudinally adjustable counter to the force of a closing spring 21 is disposed in the bore 90; it is guided in sealing fashion in a portion of the bore 90 remote from the combustion chamber, and toward the combustion chamber, it changes over into a portion of smaller diameter, forming a pressure shoulder 88. On the end toward the combustion chamber, a valve sealing face 81 is formed on the valve member 100, which face cooperates with the valve seat 83 and thus opens and closes the injection openings 92 by means of the longitudinal motion of the valve member 100. The pressure shoulder 88 is disposed in a pressure chamber 11, embodied in the valve body 80, which chamber continues, toward the valve seat 83, into an annular gap surrounding the valve member 100 and can be filled with fuel via an inlet conduit 3 embodied in the valve body 80. By the hydraulic force on the pressure shoulder 88, the valve member 100 can be moved within the bore 90, counter to the force of the closing spring 21, so that the injection openings are opened.

On the end remote from the combustion chamber, the valve member 90 changes into a spring plate 103 and adjoining that into a spring tappet 107, both of which are disposed in a spring chamber 105 embodied in the valve holding body 96. The spring chamber 105 is embodied with a graduated diameter and is enlarged toward the end remote from the combustion chamber, forming a control piston stop face 43 embodied as an annular shoulder.

On the end of the spring chamber 105 remote from the combustion chamber, a combined hydraulically and piezoelectrically controlled stroke stop is provided, of the kind already described above in the description of the outward-opening fuel injection valve of FIGS. 1 and 3, so that only some details of it need to be addressed here. Toward the combustion chamber, the control piston 30 is disposed toward the control stop 31, and the closing spring 21 surrounding the spring tappet 107 is disposed between the control piston's face end toward the combustion chamber and the spring plate 103 and, with the valve sealing face 81, presses the valve member 100 against the valve seat 83. The valve member 100, on its end remote from the combustion chamber, has a stop face 109, which as a result of the opening stroke motion of the valve member 100 in the direction away from the combustion chamber comes to rest on the control piston 30. Upon activation of the hydraulic stop or piezoelectric actuator, the control piston 30 moves counter to the force of the closing spring 21; the control piston stop face 43 defines the maximum path of the control piston 30. As a result, the stroke stop face 42 embodied on the control piston 30 is displaced as well and thus reduces the maximum possible opening stroke of the valve member 100.

Alternatively to the hydraulic stroke stop shown in FIG. 3 or FIG. 5, it can also be provided that the entire control piston 30 is embodied as a piezoelectric actuator. Then there is no need for connecting the preferably metal hydraulic piston 27 to the piezoelectric actuator 26. It can also be provided that the support disk 25 is omitted and that the stroke stop face 42 is embodied on the piezoelectric actuator 26.

It should be noted in FIGS. 1, 3 and 5 that the piezoelectric actuator 26 has been shown only schematically, for the sake of simplicity. The size and in particular the axial length of the piezoelectric actuator 26 must be selected to suit the particular application, taking into account the slight relative change in length of the piezoelectric actuator.

What is claimed is:

1. A fuel injection valve for an internal combustion engine comprising: a valve body (1, 80) having an axially extending bore (2), a piston like valve member (5, 100) movable axially within said bore (2) counter to a closing force, said valve member being guided in said bore (2) over a portion of its length and controlling at least one injection opening (13*a*, 13*b*, 92), which can be opened entirely or in part by an opening stroke motion of said valve member (5, 100), a pressure chamber (11) formed in said valve body surrounding a portion of said valve member and adapted for connection with a high-pressure fuel source (55), a pressure shoulder (18) formed on said valve member and being located within said pressure chamber whereby connection of said pressure chamber to said high-pressure fuel source exposes said pressure shoulder to high-pressure causing said valve member to initiate its opening stroke motion counter to said closing force and said at least one injection opening to communicate with said pressure chamber (11), and an axially moveable control piston (30), defining the maximum opening stroke of the valve member (5, 100), one end face of said control piston acting as a stroke stop face (42) to limit the opening stroke motion of said valve member (5, 100) and an opposite end face (35) of said control piston defining a control chamber (33) adapted for connection to said high-pressure fuel source, the improvement wherein said control piston (30) comprises a piezoelectric actuator (26).

2. The fuel injection valve of claim 1, wherein said valve member (5, 100) is formed with a stop face (41, 109) which, in the opening stroke motion of the valve member, comes to rest on the stroke stop face (42) of said control piston (30).

3. The fuel injection valve of claim 2, wherein the control piston (30) comprises a hollow cylinder, which is disposed coaxially to the valve member (5, 100) and is guided in a guide bore (6) in said valve body.

4. The fuel injection valve of claim 3, wherein the control piston (30) comprises a stepped piston having portions of different diameters, including a larger diameter portion having an end face located near the stop face (41, 109) of said valve member (5, 100) and serving as said stroke stop face (42), and a smaller diameter portion having an end face (35) remote from the stroke stop face (42) which defines a wall of said control chamber (33).

5. The fuel injection valve of claim 4, wherein the piezoelectric actuator (26) comprises a hollow cylinder and is disposed coaxially to the valve member (5, 100).

6. The fuel injection valve of claim 5, wherein only a part of the control piston (30) is formed by the piezoelectric actuator (26), and the piezoelectric actuator (26) is disposed such that it is oriented toward the stop face (41, 109) of the valve member (5, 100).

7. The fuel injection valve of claim 6, wherein the valve member (5), to open the injection openings (13*a*, 13*b*), executes said opening stroke motion oriented outward, toward a combustion chamber of said internal combustion engine when the fuel injection valve is mounted on the engine.

8. The fuel injection valve of claim 7, wherein the valve member (5) includes an annular collar (40) having an annular end face, which is oriented toward the combustion chamber of said internal combustion engine when the fuel injection valve is mounted on the engine, and serving as the stop face (41), which cooperates with the stroke stop face (42) of the control piston (30).

9. The fuel injection valve of claim 3, wherein the valve member (5), to open the injection openings (13*a*, 13*b*), executes said opening stroke motion oriented outward, toward a combustion chamber of said internal combustion engine when the fuel injecting valve is mounted on the engine.

10. The fuel injection valve of claim 9, wherein the valve member (5) includes an annular collar (40) having an annular end face, which is oriented toward the combustion chamber of said internal combustion engine when the fuel injection valve is mounted on the engine, and serving as the stop face (41), which cooperates with the stroke stop face (42) of the control piston (30).

11. The fuel injection valve of claim 3, wherein the control chamber (33) is adapted to communicate with the high-pressure fuel source (55) via a control valve (57).

12. The fuel injection valve of claim 11, wherein the control chamber (33) is adapted to communicate with a relief chamber (50) via a control valve (61).

13. The fuel injection valve of claim 12, wherein the high-pressure fuel source is embodied as a high-pressure reservoir (55).

14. The fuel injection valve of claim 2, wherein the control piston (30) includes a support disk (25) disposed at an end face of the control piston (30) toward the stop face (41, 109) of the valve member (5, 100), and a face of said a support disk (25) serves as the stroke stop face (42).

15. The fuel injection valve of claim 14, wherein the valve member (5), to open the injection openings (13*a*, 13*b*), executes said opening stroke motion oriented outward, toward a combustion chamber of said internal combustion engine when the fuel injection valve is mounted on the engine.

16. The fuel injection valve of claim 14, wherein the control chamber (33) is adapted to communicate with the high-pressure fuel source (55) vial a control valve (57).

17. The fuel injection valve of claim 2, wherein said closing force is supplied by at least one closing spring (21) disposed in a spring chamber (20, 105) in said valve body.

18. The fuel injection valve of claim 17, wherein the control piston (30) is guided in a guide bore (6) adjacent said spring chamber (20) in said valve body, said guide bore (6) having a larger diameter than said spring chamber (20) and an annular end face (43) at the transition from the guide bore diameter to the spring chamber diameter, which limits the axial motion of the control piston (30) in the direction of the stop face (41, 109) of the valve member (5, 100).

19. The fuel injection valve of claim 18, wherein the closing spring (21) rests at least indirectly on the stroke stop face (42) of the control piston (30), so that the closing spring (21) acts counter to the stroke of the control piston (30).

20. The fuel injection valve of claim 17, wherein the closing spring (21) rests at least indirectly on the stroke stop face (42) of the control piston (30), so that the closing spring (21) acts counter to the stroke of the control piston (30).

21. The fuel injection valve of claim 1, wherein the valve member (5), to open the injection openings (13*a*, 13*b*), executes said opening stroke motion oriented outward, toward the combustion chamber of said internal combustion engine when the fuel injection valve is mounted on the engine.

22. The fuel injection valve of claim 21, wherein the valve member (5) includes an annular collar (40) having an annular end face, which is oriented toward the combustion chamber of said internal combustion engine when the fuel injection valve is mounted on the engine, and serving as a stop face (41), which cooperates with the stroke stop face (42) of the control piston (30).

23. The fuel injection valve of claim 1, wherein the control chamber (33) is adapted to communicate with a high-pressure fuel source (55) vial a control valve (57).

24. The fuel injection valve of claim 23, wherein the control chamber (330 is adapted to communicate with a relief chamber (50) via a control valve (61).

25. The fuel injection valve of claim 23, wherein the high-pressure fuel source is embodied as a high-pressure reservoir (55).

* * * * *

UNITED STATES PATENT AND TRADEMARK OFFICE

CERTIFICATE OF CORRECTION

PATENT NO. : 6,732,949 B1
DATED : May 11, 2004
INVENTOR(S) : Horst Harndorf

It is certified that error appears in the above-identified patent and that said Letters Patent is hereby corrected as shown below:

Title page,
Item [75], should read as follows:
-- [75] Inventor: Horst Harndorf, Schwieberdingen (DE) --

Item [86], should read as follows:
-- [86] PCT No.: PCT/DE 00/04184 --

Signed and Sealed this

Sixth Day of July, 2004

JON W. DUDAS
*Acting Director of the United States Patent and Trademark Office*